US005634887A

United States Patent [19]

Fortiér

[11] Patent Number: 5,634,887

[45] Date of Patent: Jun. 3, 1997

[54] POWER MASSAGER

[76] Inventor: Richard Fortiér, 5237 Blvd. Hamel Ouest Suite 130, Quebec, Quebec, Canada, G2E 2H2

[21] Appl. No.: 464,563

[22] Filed: Jun. 5, 1995

[30] Foreign Application Priority Data

Mar. 4, 1995 [CA] Canada ..... 2146223

[51] Int. Cl.[6] ..... A61H 15/00

[52] U.S. Cl. ..... 601/115; 601/122

[58] Field of Search ..... 601/115, 122, 601/128; 482/132, 139

[56] References Cited

U.S. PATENT DOCUMENTS

| | | | |
|---|---|---|---|
| 1,836,981 | 12/1931 | Matheson | 601/115 |
| 3,707,284 | 12/1972 | Waldeck | 601/115 |
| 3,892,404 | 7/1975 | Martucci . | |
| 4,193,394 | 3/1980 | Everett et al. . | |
| 5,078,125 | 1/1992 | Schumacher . | |
| 5,094,225 | 3/1992 | Craw . | |
| 5,215,511 | 6/1993 | Cheng . | |
| 5,336,152 | 8/1994 | Winslow et al. . | |
| 5,352,188 | 10/1994 | Vitko | 601/115 |

FOREIGN PATENT DOCUMENTS

| | | |
|---|---|---|
| 1303923 | 6/1992 | Canada . |

*Primary Examiner*—Robert A. Hafer
*Assistant Examiner*—Benjamin Koo
*Attorney, Agent, or Firm*—Birch, Stewart, Kolasch & Birch, LLP

[57] ABSTRACT

Massage equipment is provided herein. It includes a rigid frame, and at least one massage roll carried by the frame and which is freely rotatable about an axis which is fixed relative to the frame. Apparatus is provided for assisting a user, when supported against that roll, to move across that roll while applying pressure to that roll to cause roll rotation and to provide massaging action.

24 Claims, 6 Drawing Sheets

POWER MASSAGER

BACKGROUND OF THE INVENTION

1. Field of the Invention

This invention relates to massage equipment.

2. Description of the Prior Art

Massage equipment, as suggested in prior patent publications, and basically in the form of back massagers, tends to provide complex mechanisms for massaging. For instance, in Canadian Patent 1,303,923, a back massager is described which includes vibrators and which require to be operated by an AC power supply. Further, U.S. Pat. No. 5,078,125 describes a back contacting member which is reciprocated over a person's back by a reciprocating mechanism which also requires electrical operation in conjunction with a control circuit. Electrical power is also employed for actuating a personally operated portable back massager described in U.S. Pat. No. 5,094,225. In the latter Patent, eccentrically rotating massaging rolls are driven by electrically operated mechanical driving means. Also in a personally operated apparatus, which is basically an indoor gymnastic apparatus as described in U.S. Pat. No. 5,215,511, a means for massaging a person's back is employed. This particular apparatus does not require any power driving means. It does, however, require many moveable parts to effect a massaging operation in which massaging rolls are forced to move relative to a fixed structure of the apparatus in conjunction with a rocking motion of the user's body so as to massage the user's back.

SUMMARY OF THE INVENTION (i) Aims of the Invention

The present invention seeks to provide massaging equipment which is simple in construction and does not require a driving mechanism to provide a massaging action.

(ii) Statement of Invention

Accordingly, the present invention provides, as a broad embodiment, massage equipment comprising a rigid frame, at least one massage roll carried by the frame and freely rotatable about an axis which is fixed relative to the frame, and means for assisting a user, when supported against a massage roll, to move across such massage roll while applying pressure to such massage roll to cause such massage roll to rotate and to provide a massaging action.

The present invention also provides, as a second embodiment, massage equipment comprising a massage roll carrier having handle at one end and at least two freely-rotatable rolls disposed, one on each side of the massage roll carrier, at positions spaced along the massage roll carrier from the handle means.

(iii) Other Features of the Invention

While a single roll may be functionally all that is required for massaging, the frame preferably is elongate and a plurality of rolls are provided, the rolls being laterally spaced apart in the elongate direction of the frame and being rotatably-mounted to the frame about fixed axes extending transverse to the frame length. With this preferred arrangement, each of the rolls may perform a massaging action upon different parts of a user during a single movement of the user across the rolls.

Preferably the means for assisting the user to move over the rolls comprises a support for upper regions of the user, the support being carried upon a mounting structure. Under the influence of a force applied by the user, the mounting structure is reciprocally movable longitudinally of the rigid frame to move the support towards and away from the plurality of rolls. The user applies force to the mounting structure when he moves across the rolls to initiate the reciprocal movement of the mounting structure. With this preferred arrangement, a resilient means is also preferably used to hold the mounting structure in a normal position with the support relatively close to the plurality of rolls. The mounting structure is movable, against the influence of the resilient means, in a direction away from the normal position by the action of the user, to move the support further from the plurality of rolls, the resilient means then acting to return the mounting structure to its normal position.

As may be seen, with this arrangement, the user has complete control over the massaging action. With his upper regions supported, the user merely needs to move the support away from the rolls as the user moves in one direction across the rolls, the movement in the opposite direction across the rolls is accompanied by a return of the mounting structure to the normal position under the influence of the resilient means. As may be seen with this preferred arrangement, with the rigid frame located in a suitable position, the user may apply pressure with the feet against a suitable abutment surface, e.g., the floor, to cause the mounting structure to move relative to the frame against the action of the resilient means. Return movement of the person is again actuated by leg action. With this type of usage, the user not only massages his back but also obtains some positive and beneficial exercise to the muscles in his legs and feet and perhaps also to his shoulder and neck muscles.

Also in another preferred arrangement, the elongate rigid frame comprises an elongate frame member having the rolls extending outwards from each side of the frame member and the mounting structure is carried by the frame member. This preferred arrangement tends towards optimization of the structural simplicity and minimises the number of parts with a single frame member not only supporting the rolls but also carrying the mounting structure.

Advantageously, the elongate frame member is tubular and the mounting structure is also elongate and is received within the frame member for its reciprocal movement longitudinally of the frame member with one end of the mounting structure extending from one end of the frame member and carrying the support.

The mounting structure may be telescopically slidable within the tubular frame member, and the mounting structure is also elongate and is received within the frame member for reciprocal movement longitudinally of the frame member, one end of the mounting structure extending from one end of the frame member and carrying the support. It is preferred for the mounting structure to be supported within the frame member by wheels which are carried by the mounting structure and which permit the reciprocating movement of the mounting structure. With this latter arrangement and with simplicity of construction in mind, the mounting structure is advantageously carried by at least one wheel which is rotatable upon the structure at a specific distance from the support and which engages the lower regions of the frame member, and by at least one other wheel rotatable upon the mounting structure at a greater distance from the support, the at least one other wheel engaging upper regions of the frame member. Thus at least one other wheel is spaced at a greater distance from the support engages upper regions of the frame member. This particular arrangement, which is extremely simple in construction, effectively holds the mounting structure longitudinally in position within the frame member for reciprocating purposes and prevents any downward tilting.

By another feature of this invention, the tubular frame member is of rectangular cross-section with upper and lower horizontal sides and the mounting structure is of rectangular cross-section, and the mounting structure is carried upon the tubular frame member by a first pair of wheels rotatably mounted one wheel upon each side of the mounting structure at a specific distance from the support, the first pair of wheels engaging the lower horizontal side of the frame member, and by a second pair of wheels rotatably mounted one wheel upon each side of the mounting structure at a greater distance from the support, the second pair of wheels engaging the upper horizontal side of the tubular frame member.

By yet another feature of this invention, the assisting means comprises a support for upper regions of the user, the support carried upon a mounting structure, and resilient means to urge the mounting structure into a normal position with the support relatively close to the plurality of rolls, the mounting structure being pivotally moveable downwards against the influence of the resilient means to pivot the support away from the plurality of rolls, the resilient means then being operable to return the mounting structure into the normal position.

By still another feature of this invention, the support comprises a head rest.

By yet another feature of this invention, the rolls are resiliently compressible, e.g., made from foam.

By still another feature of this invention, the assisting means comprises handle means secured to the rigid frame to enable the user to pull himself across the rolls.

By a feature of the second embodiment of the invention, two laterally-spaced rolls are disposed on at least one side of the carrier, e.g., wherein the two rolls on at least one side of the carrier are rotatably mounted in laterally spaced positions upon an arm which is pivotally mounted upon the roll carrier about an axis which is disposed intermediate the two rolls.

By another feature of the second embodiment of the invention, two pairs of rolls are disposed on each side of the carrier, the two pairs which are disposed on each side of the carrier being rotatably-mounted in laterally-spaced positions upon an individual arm which is pivotally mounted upon the roll carrier about an axis intermediate the two pairs of rolls, and the rolls of each pair are coaxial and are spaced apart to accept the roll carrier between them during pivoting of their individual arm, the individual arm on each side of the carrier being independently pivotal of the other individual arm.

Massage equipment according to this second embodiment of the invention is particularly useful for the user to massage his own back when he is standing. To hold one of these rolls, acting as a massaging roll, against the user's back, the user, with his back close to a wall, locates the equipment between the wall and his back and moves the equipment vertically with the other roll moving up and down the wall surface. This action causes the massaging roll to be forced against the user's back so as to provide the massaging action. The degree of pressure applied does, of course, depend on the pressure applied by the user upon the equipment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS (i) Description of FIGS. 1 to 4

Figure 1:
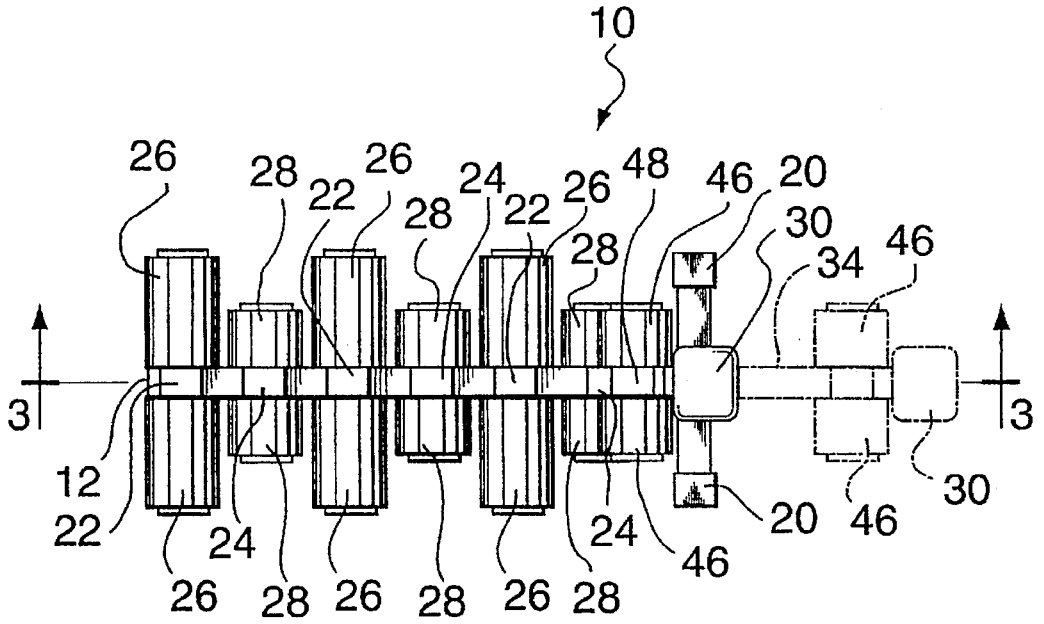
FIG. 1 is a plan view of a back massage equipment according to a first embodiment of this invention.
Figure 2:
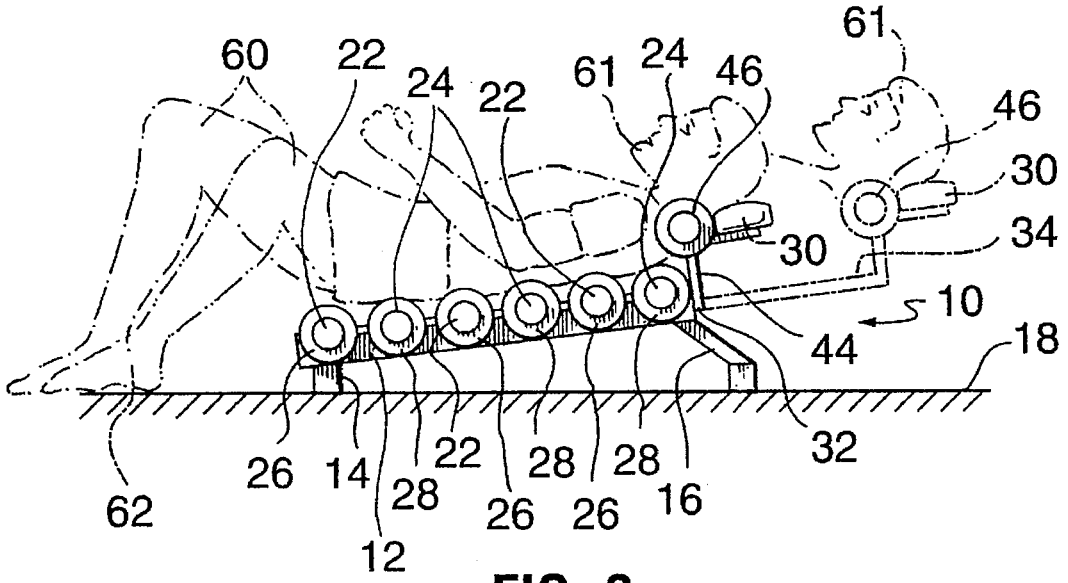
FIG. 2 is a side elevational view of the equipment of FIG. 1 taken in the direction of arrow 2 in FIG. 1.

In a first embodiment as shown in FIGS. 1 and 2, massage equipment 10 comprises a rigid frame including an elongate frame member 12. The frame member 12 has a short support 14 at one end and a longer support 16 at the other end for supporting the frame member 12 in an inclined position from the floor 18 as shown in FIG. 2. The long support 16 includes a horizontal foot 20 extending from each side of the support for lateral stability of the equipment. The support 14 extends as a horizontal support at the other end of the frame member 12 for the same purpose.

Figure 4:
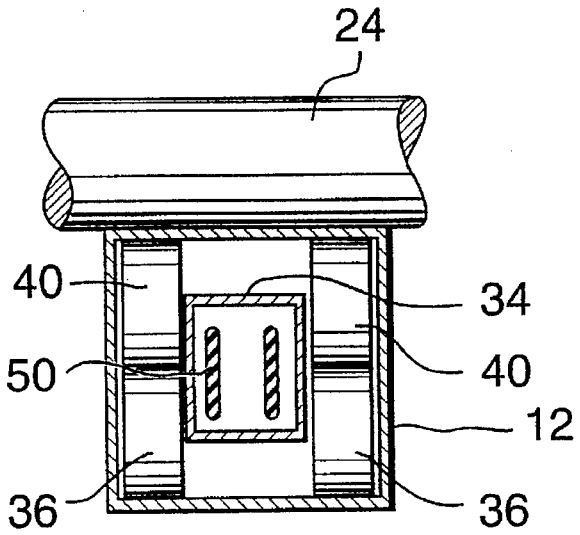
FIG. 4 is a cross-sectional view through the equipment of the first embodiment of this invention taken along line 4—4 in FIG. 3.

The frame member 12 as shown by FIG. 4, is tubular with a rectangular cross section, i.e. a square cross section in this embodiment. The frame member 12 carries three short axles 24 and three long axles 22 which extend symmetrically across the frame member 12 and alternate in size in spaced apart positions along the length of the frame member 12. Each of the axles is welded to the flat top surface of the frame member as shown by FIG. 4. Each long axle 22 rotatably carries two freely rotatable massaging rolls 26, one roll positioned on each side of and spaced from the frame member 12. Each of the short axles 24 carries two freely rotatable rolls 28, one on each side of and spaced from the frame member 12. While the rolls may be of any suitable diameter, length and hardness for the required massaging purpose, in this embodiment there are specific requirements in these areas. For instance, each roll is of four inches diameter with rolls 26 being of six inch length and rolls 28 of three inch length. The rolls are all resiliently compressible and are formed from foamed polymeric material.

Figure 3:
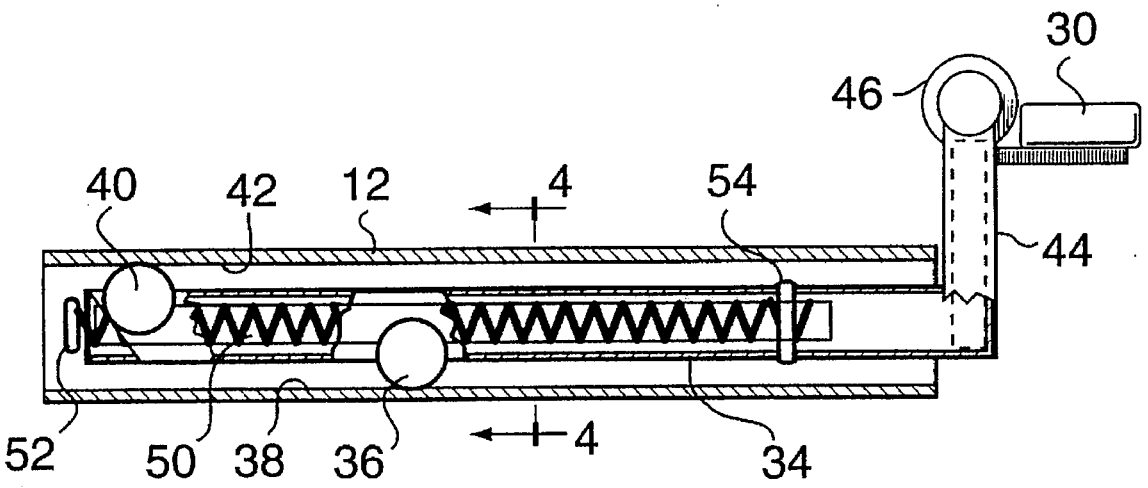
FIG. 3 is a cross-sectional view through the equipment of the first embodiment taken along line 3—3 in FIG. 1 and with parts omitted for clarity.

It is intended that a user of the equipment should support his back upon the rolls 26 and 28, in the manner shown in FIG. 2, with the object of moving his body in the lengthwise direction of the frame member 12 to cause rotation of the rolls 26 and 28 while massaging his back. The massage equipment of this embodiment is provided with a means to assist in enabling a user who is supported against the rolls to move over the rolls during the massaging function. This assisting means comprises a support in the form of a head rest 30 which is carried upon a mounting structure, generally shown at 32. As will be described, the mounting structure 32 is reciprocally movable longitudinally of the frame member 12 to move the head rest towards and away from the rolls 26 and 28. This movement is between a normal full outline position in FIGS. 1 and 2 and a chain dotted position. The mounting structure 32 comprises an elongate structural member 34 which is also of square tubular section, but is smaller than the section of the frame member 12 so as to be received within it as shown in FIGS. 3 and 4. The structural member 34 is centrally positioned in axial cross-section of the member 12 and is held in this position by wheels disposed within the member 12 and which allow for longitudinal movement of the structural member 34 within the frame member. A first pair of wheels 36 is rotatably mounted one wheel on each side of the structural member 34 in a position towards a central region of the member 34 as shown in FIG. 3. These wheels 36 support the downward weight of the member against the lower upwardly facing inner surface 38 of the frame member 12. Another pair of wheels 40 is rotatably mounted towards the top of, and one at each side of, the structural member 34 close to the lower end of the structural member, i.e. at a position furthest from the head rest 30. These wheels 40 engage the upper downwardly facing inner surface 42 of the frame member 12. As may be seen, the two pairs of wheels are disposed in positions such that any tendency for the structural member 34 to tilt downwardly about the pair of wheels 36 under the influence of weight is prevented by the wheels 40 engaging the surface 42 of the frame member 12. As there is no likelihood of the structural member 34 tilting in the opposite direction in use, then other wheels to prevent such tilting action are unnecessary.

The higher right hand end of the structural member 34 as viewed in FIGS. 2 and 3, carries an upward extension 44 for the head rest 30. Near the head rest 30, the extension 44 also carries two short rotatable rolls 46 similar in construction and size to the rolls 28. The rolls 46 are spaced apart one on each side of the axis of the structural member 34 and a smaller diameter foam roll 48 is positioned between them.

A resilient means is provided to urge the mounting structure 32 into its normal full outline position in FIGS. 1, 2 and 3. This resilient means comprises an annular flexible elastic member 50. The elastic member 50 extends longitudinally within the structural member 34 and outwardly therefrom at an open lower end of the member to have one loop passing around a pin 52 fixed at the left hand end of the frame member 12 (FIG. 3). The other loop of the elastic member 50 passes around another pin 54 which is secured through the structural member 34. The elastic member 50 is in a slightly tensed condition with the mounting structure 32 in its normal full outline position and is of sufficient strength to withstand the tensile stresses placed upon it by the longitudinally outward movement of the mounting structure 32 in use as will be described. Alternatively, the elastic member 50 is replaced by another tensile element such as a tension spring (not shown).

In the second and third embodiments, to be described hereinafter, parts bearing the same numerals as in the first embodiment are fundamentally of the same construction and operation.

Figure 5:
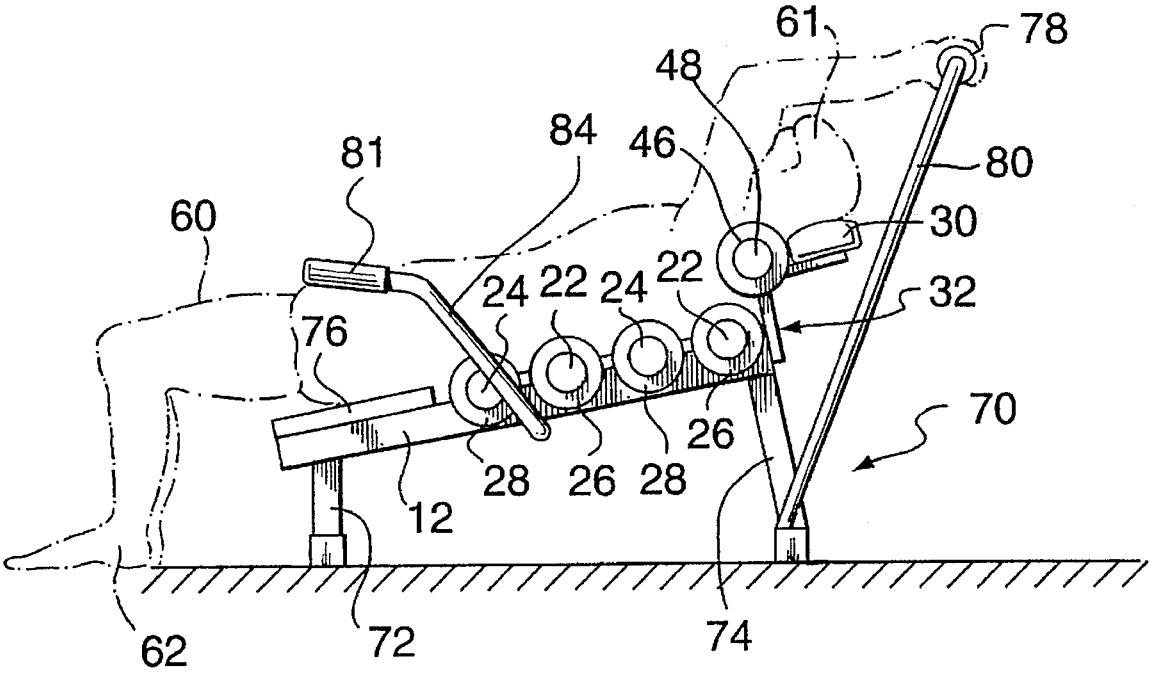
FIGS. 5 and 6 are side elevational views of a back massage equipment according to a second embodiment of this invention and showing two different positions in use.

(ii) Description of FIG. 5

In a second embodiment as shown in FIG. 5, massage equipment 70 comprises a rigid frame with an elongate frame member 12 as in the first embodiment. The frame member 12 is inclined to a larger angle to the horizontal and is positioned higher than the frame member 12 in the first embodiment. At its lower end the frame member 12 is supported by a support 72 and a longer support 74 is provided at its higher end, the two supports being stabilized to prevent toppling in a lateral direction. The frame member 12 carries a plurality of massaging rolls 26 and 28, but differs from the first embodiment in that at its lower end it has a flat cushioned platform 76 which extends outwardly over the support 72. There is also a mounting structure 32 provided with a head rest 30 and which is reciprocally moveable longitudinally of the frame member 12 as in the first embodiment. In addition to this, however, the apparatus 70 of the second embodiment comprises two pairs of handles 78 and 81, the handles of each pair being aligned in FIG. 5 so that only one handle of each pair is shown. The handles 78 are mounted at the ends of long bars 80 which extend upwardly from the support 74 to locate the handles in spaced positions one on each side of the axis of reciprocation of the structure 32. The bars 80 are positioned sufficiently far apart to enable the head rest 30 and the upper part of the person's body to pass between them. The lower handles 81 are mounted upon the ends of bars 84 which extend upwardly from beneath the frame member 12 so as to be disposed one to each side of the cushioned platform 76 and at a position above it.

Figure 7:
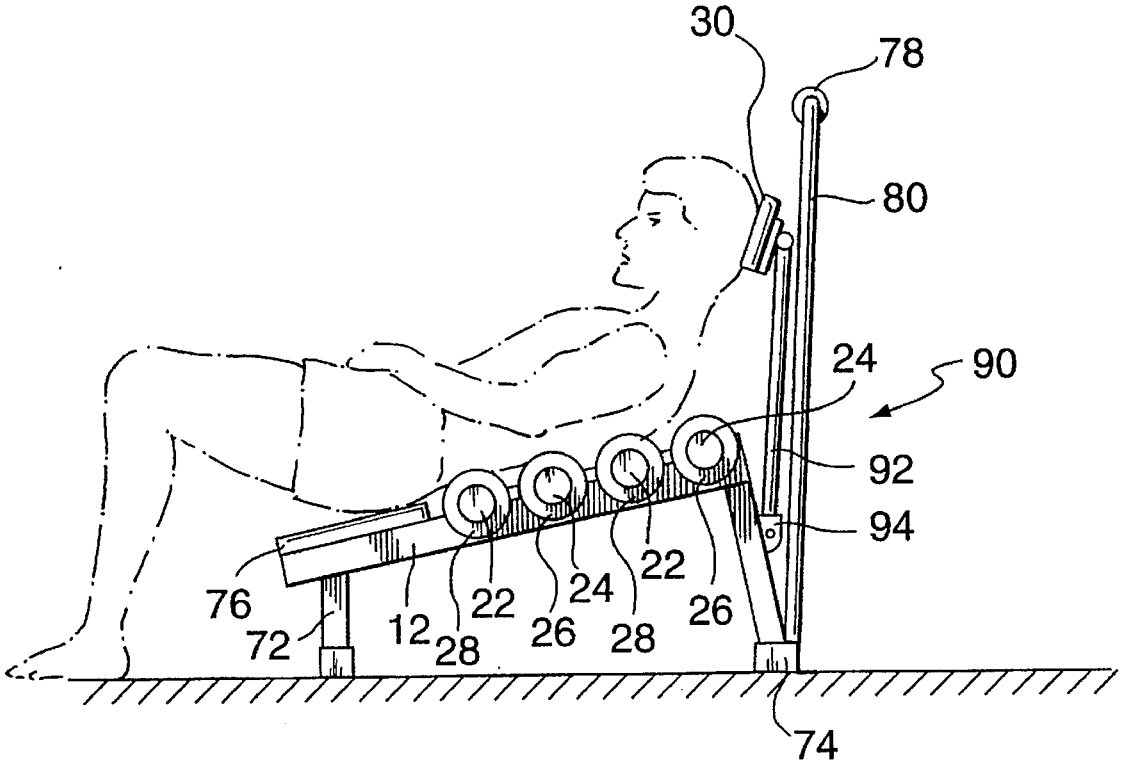
FIGS. 7 and 8 are views similar to FIGS. 5 and 6 of back massage equipment according to a third embodiment of this invention.
Figure 8:
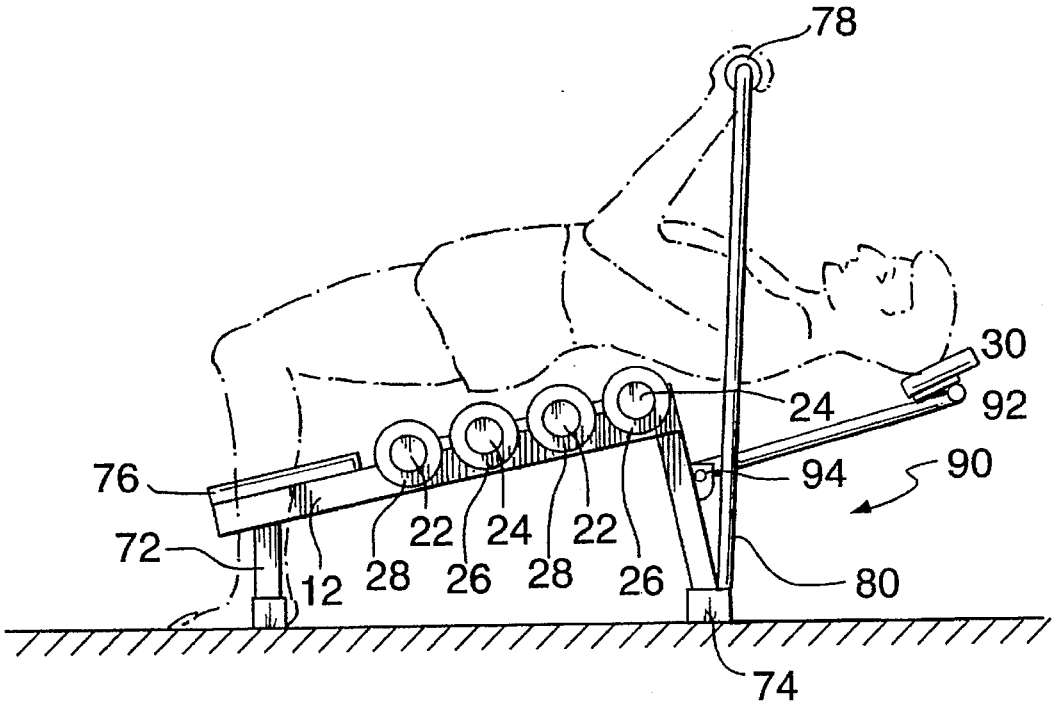

(iii) Description of FIGS. 7 and 8

In a third embodiment shown in FIGS. 7 and 8, massage equipment 90 is basically of the same structure as that described in the second embodiment except that the mounting structure 32 for the head rest 30 is replaced by a different means for assisting the user to move over the rolls 26 and 28 during a massaging treatment. As shown by FIG. 7, the head rest 30 is mounted upon the upper end of an arm 92 which is pivoted at its lower end to the support 74 or to another part of the rigid structure as required. A torsion spring (not shown) is mounted around the lower pivotal axis 94 of the arm 92 and urges the arm 92 in a counter-clockwise direction, as viewed in FIG. 7, so that it normally assumes a substantially upright position with the head rest 30 close to the rolls 26 and 28.

Figure 9:
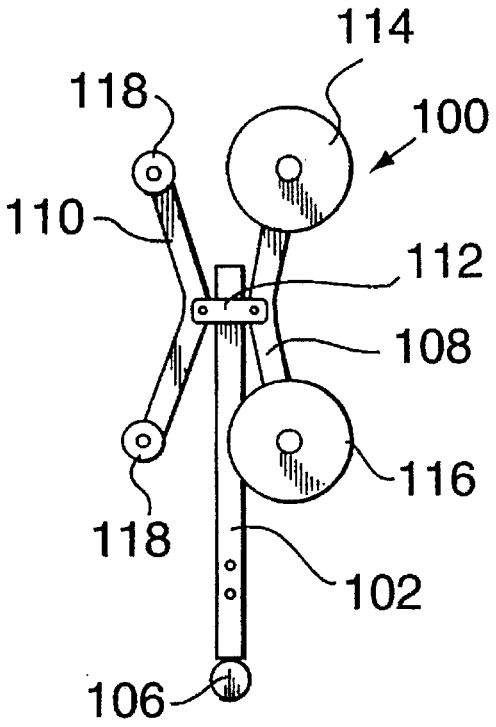
FIG. 9 is a side elevational view of back massage equipment according to a fourth embodiment of this invention.
Figure 10:
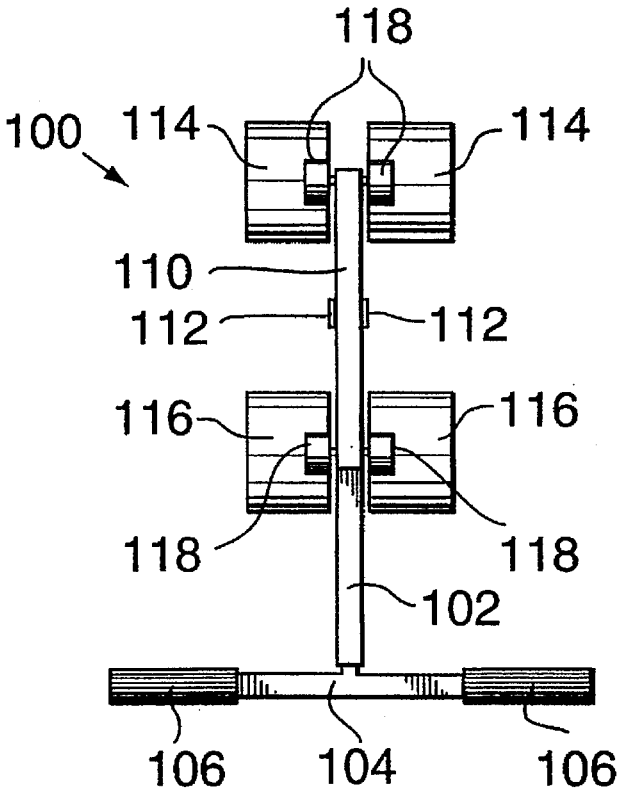
FIG. 10 is a view of the equipment of FIG. 9 in the direction of arrow 10 in FIG. 9.

(iv) Description of FIGS. 9 and 10

In a fourth embodiment, massage equipment 100 as shown in FIGS. 9 and 10 is to be used for massaging a user's back by a completely different process. As shown in these two Figures, the equipment comprises a tubular roll carrier 102 provided at one end with a handle means in a form of a cross bar 104 having a handle 106 at each end. Towards the other end of the carrier 102 two arms 108 and 110 are pivotally mounted midway between their ends between two short cross members 112 which extend laterally one across each side of the carrier 102 and are secured to the carrier. Each of the arms 108 and 110 is cranked at its pivotal position to allow it to pivot upon the cross members 112 for a desired pivotal movement. The cranking angle for each arm 108 and 110 is as desired, but in this particular embodiment, each arm is cranked at an angle of approximately 12 degrees. The arm 108 pivotally supports a pair of resiliently compressible foam rolls 114 and 116, one pair at each end. The foam rolls 114 at one end of the arm 108 are four inches outside diameter and have a three inch length whereas the rolls 116 at the other end are four inches in diameter and four inches in length. The rolls of each pair are positioned one on each side of the carrier 102 so that upon pivotal movement of the arm 108 the carrier 102 may pass between the rolls of each pair. The arm 110 carries at each end a pair of smaller diameter hard rolls 118 which are similarly positioned one on each side of the carrier 102. All of the rolls may be rotatably carried upon a shaft passing through the respective arm 108 or 110 as shown by FIG. 9 or upon a shaft which is secured on one side of the respective arm (not shown).

Use of the Embodiments of the Invention (i) Use of the Apparatus of the First Embodiment In use of the apparatus of the first embodiment, a user 60 shown in chain dotted outline in FIG. 2 lies with his back resting upon the rolls 26 and 28 with his head 61 supported by the head rest 30 in its normal full outline position. In this position, his neck area lies between the rolls 46 and rests upon the roll 48. All of the rolls are resiliently compressed dependent upon the supported weight of the user. The feet 62 of the user are supported upon the ground 18 with the legs extending upwards.

To massage his back, the user exerts pressure against the floor with his feet thereby pushing his body upwards along the rolls. The user's shoulders which engage the rolls 46 urge the head rest 30 away from the rolls 26 and 28 thereby moving the mounting structure 32 towards the dotted outline position shown in FIGS. 1 and 2. Resilient stretching of the elastic member 50 accompanies this movement. Also movement of the user's body across the rolls 26 and 28 causes the rolls to rotate so as to massage the user's back. The user will then pull with his legs in the opposite direction so that his body moves towards the lower end of the frame member 12, the rolls 26 and 28 then being rotated in the opposite direction to apply pressure to his back to continue massaging. To assist in such return movement, the massager is tilted at a suitable angle. During this return movement the mounting structure 32 is returned to the normal full outline position under the force applied by the stretched elastic member 50 whereby the head rest 30 is maintained in contact with the user's head. This completes a massaging cycle. To continue massaging his back, the user then repeats the massaging cycle as desired.

As may be seen from FIG. 1, in use the user's back may lie directly above the frame member 12 so that the rolls 26 and 28 apply pressure to the muscles on each side of the spine. All of the rolls 26 and 28 massage the area immediately outwardly from the spine area whereas the rolls 26 also massage outwardly beyond this position so that a complete massaging effect is provided over the whole of the user's back.

(ii) Use of the Apparatus of the Second Embodiment

In use of the equipment of the second embodiment, the user 60 lies with his back supported by the rolls 26 and 28, his legs extending over the lower end of the structure and his feet supported on the floor.

Figure 6:
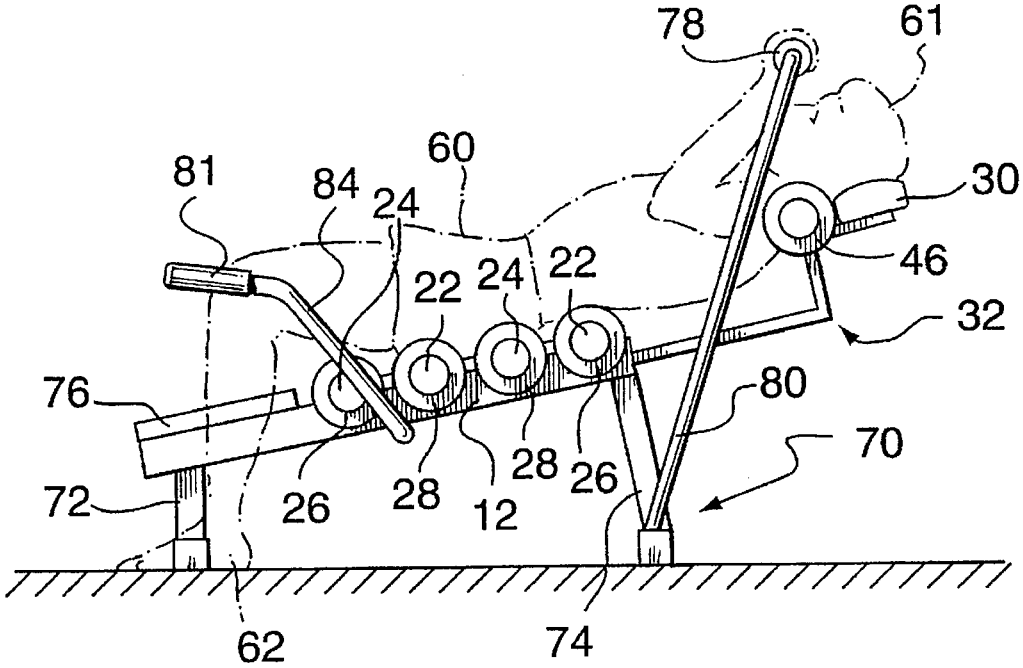

The massaging operation is somewhat similar to that in the first embodiment with pressure being exerted by the legs against the floor for the upward movement to push the head rest 30 from the position in FIG. 5 into the position in FIG. 6. However, in the second embodiment, the user may grip the handles 78 so as to assist in pulling himself upwardly along the inclined structure. This pulling action may be combined with the leg action or be used instead of the leg action so that all the weight is taken by the arms. The head rest is returned to its position of FIG. 5 on the return movement by the resilient tension means as discussed in the first embodiment.

Alternatively, or in addition, the user may hold the handles 81 to move himself in reciprocating fashion over the rolls 26 and 28 by alternately pulling and pushing upon the handles 80 to provide the massaging action which is required.

Figure 11:
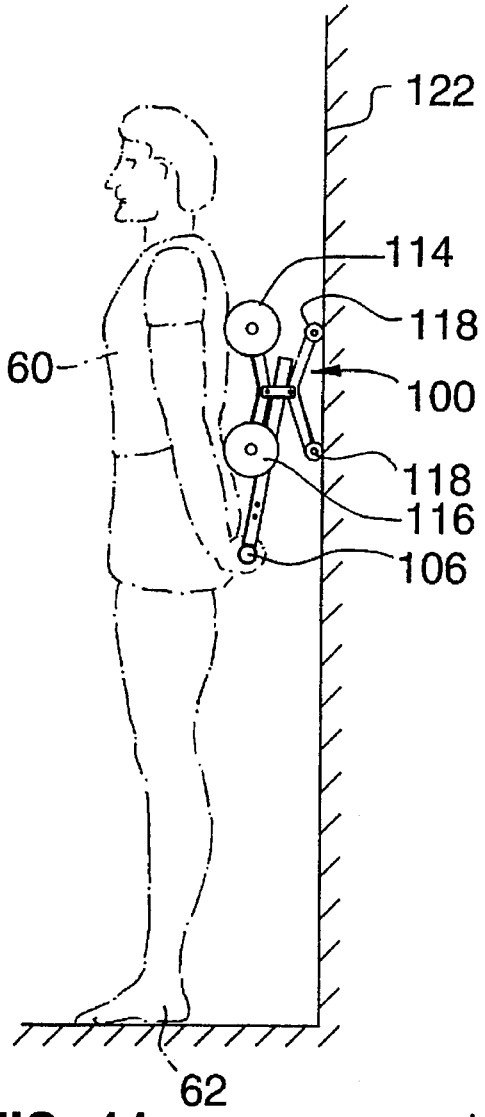
FIGS. 11 and 12 are side elevational views of a person using the massage equipment of the fourth embodiment of this invention in one manner and showing the equipment in two different positions in use.
Figure 12:
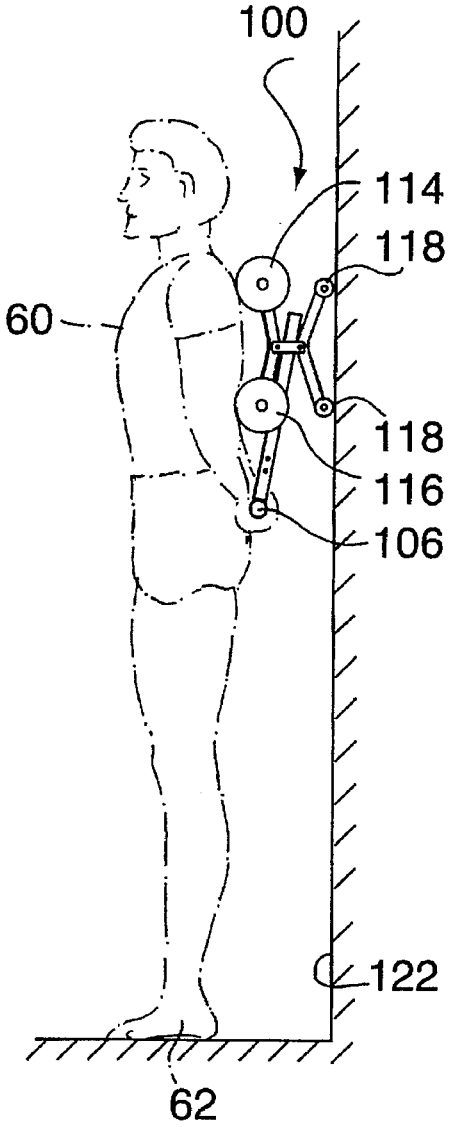
Figure 13:
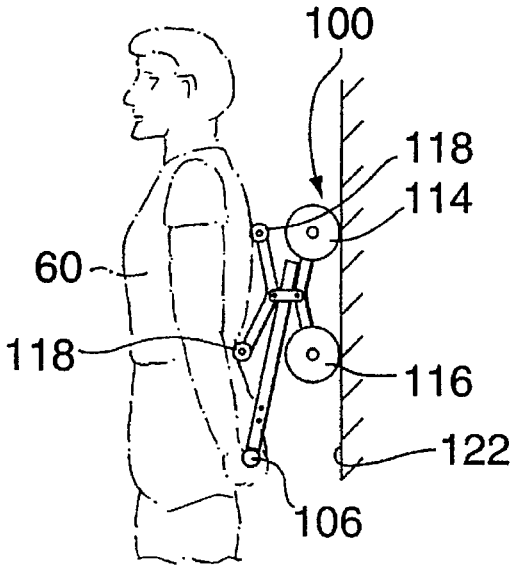
FIG. 13 is a view similar to FIG. 11 showing the massage equipment of the fourth embodiment of this invention used in a different manner.

The equipment of the second embodiment may be used in the manner shown in FIGS. 11 and 12 or as shown in FIG. 13.

As shown in FIG. 11, the user 60 stands facing away from a wall 122. He is positioned sufficiently close to the wall so as to locate the equipment 100 between himself and the wall with the rolls 118 engaging the wall surface and the other rolls 114 and 116 engaging his back. With the handles 106 positioned at the lower end of the equipment, the user grips the handles and, by leaning back towards the wall, applies pressure against the rolls 114 and 116 to force the rolls 118 against the wall surface. With the rolls 114 and 116 thus forced against his back, the user then repeatedly raises and lowers the handles 106 by suitably bending his arms. The equipment 100 is thus repeatedly reciprocated between a lower position of FIG. 11 and an upper position of FIG. 12. In the upper position, the rolls 114 may engage the top of his back near to or against his neck. Thus, in use of the equipment 100, massaging pressure is applied by the user leaning backwards towards the wall. This pressure may be varied by the user as required.

(iii) Use of the Apparatus of the Third Embodiment

In use of the equipment of the third embodiment, the user 60 lies in the position shown in FIG. 7 with his head resting against the head rest 30. The user then grips the handles 78 as in the second embodiment so as to pull himself upwardly along the inclined rolls 26 and 28 for massaging. This causes his head to force the head rest 30 backwards thereby pivoting, by means of the arm 92, around the pivot position 94 against the action of the torsion spring. As a result of this movement the user's back becomes arched. His head and neck area are pointed slightly downwards upon the head rest 30 and his legs lie one at each side of the flat pad 76 as shown in FIG. 8. Upon the user releasing the handles 78 and with minimal foot pressure upon the floor, the head rest is forced back to the position of FIG. 7 by the torsion spring and thereby moving the user back into the original position 60 in FIG. 7.

As may be seen from the second and third embodiments, the user not only massages required areas of his back on the rolls 26 and 28 but also, as in the first embodiment, the use of the equipment exercises other muscles which are not subject to the massage treatment. In addition, in both the second and third embodiments the arm action by holding the handles 78 or 80 also exercises the user's arms and chest. The use of the apparatus of the third embodiment produces an additional benefit in that the arching action of the body as shown by FIG. 8 more completely exercises muscles throughout the whole of the body than is possible with either of the first or second embodiments.

(iv) Use of the Apparatus of the Fourth Embodiment

In another method of using the equipment of the fourth embodiment (FIG. 13), the user stands in a position similar to that in FIGS. 11 and 12 and merely reverses the position of the equipment 100 so that the smaller diameter rolls 118 apply pressure against his back while the rolls 114 and 116 engage the wall. As may be seen in use of the equipment in this manner, greater localized pressure may be applied to the user's back in specific areas where massaging is required.

As indicated by the fourth embodiment, different sizes and hardnesses of rolls may be employed to provide a required massaging effect.

Conclusion

The apparatus of the first embodiment provides a simple construction which does not require power other than that provided by the user to massage his back. The simplicity of the construction is indicated by the fact that only the mounting structure is caused to move in use while a satisfactory massage is provided and the user's head is always supported. The simplicity of the structure is also indicated by the fact that only the single frame member 12 is employed to support all of the rolls and also to support the moveable mounting structure. The latter is supported while allowing for its reciprocation in an exceedingly simple, effective and economical fashion.

In addition to this, not only is the user's back massaged by use of the equipment but also he exercises the muscles of his legs and feet and, to a degree, his shoulder and neck muscles. Although of extremely simple construction, it follows that the equipment provides for simultaneous massaging and muscle exercise.

From the foregoing description, one skilled in the art can easily ascertain the essential characteristics of this invention, and without departing from the spirit and scope thereof, can make various changes and modifications to the invention to adapt it to various usages and conditions. Consequently, such changes and modifications are properly, equitably, and "intended" to be, within the full range of equivalence of the following claims.

I claim:

1. Massage equipment comprising:

a rigid longitudinally-extending, spine-like frame;

at least two massage rolls carried by said frame, each of said rolls being freely-rotatable about an axle which is fixed perpendicularly relative to the longitudinal axis of said rigid frame;

extendable means which are mounted on said rigid frame, said extendable means being extendable to move relative to said longitudinal axis of said rigid frame to project beyond a forward end of said frame; and supporting means which are mounted on said extendable means for supporting shoulders, neck and head of a user, said supporting means being operated by an appendage of a user, whereby a user, when supported against said rolls, operates said supporting means to exert relative longitudinal motion between a torso of a user and said rolls, thereby simultaneously applying pressure to said rolls to cause rotation of said rolls, to provide massaging action to a torso of a user, and to cause movement of the supporting means relative to the rigid frame.

2. The massage equipment according to claim 1, wherein said said at least two massage rolls comprise a plurality of pairs of rolls, said rolls being rotatably-mounted on respective axles which are spaced-apart along the longitudinal axis of said frame and which extend across said frame.

3. The massage equipment according to claim 2, wherein said extendable means comprises a longitudinally movable structural member which, under the influence of a force applied by a user, is reciprocally-movable longitudinally with respect to said rigid frame to move said supporting means towards and away from said plurality of rolls.

4. The massage equipment according to claim 1, wherein said extendable means comprises a pivotable structural member mounted on said rigid frame and wherein said equipment further comprises resilient means for urging said pivotal structural member into a rest position, with said supporting means being relatively close to said rolls, said pivotal structural member being pivotally movable downwards against influence of said resilient means to pivot said supporting means away from said rolls, said resilient means urging said pivotal structural member to return to said rest position.

5. The massage equipment according to claim 1, wherein said rolls are resiliently compressible.

6. The massage equipment according to claim 5, wherein said resiliently-compressible rolls are made from foamed polymeric material.

7. The massage equipment according to claim 1, wherein said supporting means comprises an upward extension of said structural member, said upward extension supporting a head rest.

8. The massage equipment according to claim 7, wherein said upward extension also supports a pair of transversely-extending rolls, which are separated by a central roll.

9. The massage equipment according to claim 2, further comprising handle means secured to said rigid frame to enable a user to pull himself across said rolls.

10. The massage equipment according to claim 2, wherein alternate axles are of a selected length and alternate axles are of a shorter length.

11. The massage equipment according to claim 2, wherein said extendable means comprises an arm pivotally mounted at a forward end of said frame and wherein said equipment further comprises resilient means for urging the arm into a rest position, said rest position of said arm being relatively close to said rolls, said arm being pivotally movable both forwardly and downwardly by a user against influence of said resilient means to pivot said support away from said plurality of rolls.

12. The massage equipment according to claim 11, wherein said rolls are resiliently-compressible.

13. The massage equipment according to claim 12, wherein said rolls are made from foamed polymeric material.

14. The massage equipment according to claim 11, wherein said force applied by a user originates from legs of a user reacting against a floor upon which said massage equipment rests.

15. The massage equipment according to claim 14, further comprising an upwardly extending bar terminating in a handle on each side of said frame and the force being applied by arms of a user pulling on said handles.

16. The massage equipment according to claim 2, wherein said frame is supported on low rear legs and high front legs, whereby said frame is upwardly forwardly tilted.

17. The massage equipment according to claim 16, wherein said legs are provided with transversely-extending feet.

18. The massage equipment according to claim 3, wherein said frame comprises a hollow member of rectangular cross-section and wherein said structural member comprises a hollow member of rectangular cross-section which is slidably fitted within said frame.

19. The massage equipment according to claim 18, further comprising resilient means cooperating between said frame and said structural member to urge said structural member into a rest position where said structural member is relatively close to said plurality of rolls, said structural member being urged by a user against the influence of said resilient means in a direction away from said rest position to move said structural member away from said plurality of rolls.

20. The massage equipment according to claim 19, wherein said structural member is slidably fitted within said frame in conjunction with and is supported within said frame by wheels which are disposed within said frame, said wheels assisting said movement of said structural member.

21. The massage equipment according to claim 20, wherein the weight of said structural member is carried upon said frame both by at least one wheel, said one wheel being rotatable upon said structural member and being in rolling contact with lower regions of said frame, and by at least one other wheel, said one other wheel being rotatable upon said mounting structure and being in rolling contact with upper regions of said frame.

22. The massage equipment according to claim 3, wherein said force applied by a user originates from legs of a user reacting against a floor upon which said massage equipment rests.

23. The massage equipment according to claim 22, further comprising an upwardly and forwardly extending bar terminating in a forwardly-extending handle on each side of said frame and wherein said force applied by a user also originates from arms of a user pulling on said forwardly-extending handles.

24. The massage equipment according to claim 23, further comprising an upwardly and rearwardly extending bar terminating in a rearwardly-extending handle on each side of said frame and wherein said force applied by a user also originates from arms of a user alternately pulling and pushing on said rearwardly extending handles.

* * * * *